US007744376B2

(12) United States Patent
Vrenna et al.

(10) Patent No.: US 7,744,376 B2
(45) Date of Patent: Jun. 29, 2010

(54) SOCKET CONNECTOR WITH POWER BLADE

(75) Inventors: Jason E. Vrenna, Angola, NY (US); Attalee S. Taylor, Palmyra, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/132,240

(22) Filed: Jun. 3, 2008

(65) Prior Publication Data

US 2009/0298303 A1 Dec. 3, 2009

(51) Int. Cl.
*H01R 9/09* (2006.01)

(52) U.S. Cl. ..... 439/60; 439/637; 439/947

(58) Field of Classification Search ..... 439/60, 439/857, 858, 629–637, 862, 947
See application file for complete search history.

(56) References Cited

U.S. PATENT DOCUMENTS 4,762,500 A * 8/1988 Dola et al. ..... 439/79
5,423,691 A * 6/1995 Pickles ..... 439/327
5,688,146 A * 11/1997 McGinley et al. ..... 439/637
5,876,214 A * 3/1999 McHugh et al. ..... 439/60
6,203,328 B1 * 3/2001 Ortega et al. ..... 439/60
6,210,240 B1 * 4/2001 Comerci et al. ..... 439/853
6,746,281 B1 * 6/2004 Zhang ..... 439/637
6,780,018 B1 8/2004 Shipe
6,832,933 B2 12/2004 Bu et al.
7,011,548 B2 * 3/2006 Bogiel et al. ..... 439/630

* cited by examiner

*Primary Examiner*—Michael C Zarroli

(57) ABSTRACT

A power blade is provided for a socket connector that connects a module card to a circuit board. The power blade includes a bus extending along a longitudinal axis, and a plurality of individual electrical contacts extending from the bus such that the electrical contacts are each electrically connected to the bus. The electrical contacts are located adjacent one another along the longitudinal axis. Each of the electrical contacts includes a side mating portion configured to electrically connect to the module card. The side mating portions of the electrical contacts lie in approximately a common plane.

17 Claims, 6 Drawing Sheets

SOCKET CONNECTOR WITH POWER BLADE

BACKGROUND OF THE INVENTION

The subject matter described and illustrated herein relates generally to electrical connectors, and, more particularly, to socket connectors for retaining electronic modules.

Computers and servers may use numerous types of electronic modules, such as processor and memory modules (e.g. Dynamic Random Access Memory (DRAM), Synchronous Dynamic Random Access Memory (SDRAM), or Extended Data Out Random Access Memory (EDO RAM), and the like). The memory modules are produced in a number of formats such as, for example, Single In-line Memory Modules (SIMM's), or the newer Dual In-line Memory Modules (DIMM's), Small Outline DIMM's (SODIMM's), and Fully Buffered DIMM's. Typically, the electronic modules are installed in one or more multi-pin socket connectors mounted on a system board or motherboard. Each electronic module has a card edge that provides an interface generally between two opposite rows of contacts in the socket connector.

There is an ongoing trend toward smaller electronic packages. This trend is accelerated by the adoption of certain standards such as the Advanced Telecommunications Computing Architecture (ATCA) standard. In systems that adhere to the ATCA standard, the space provided for electronic modules and socket connectors is limited. Moreover, the amount of electrical power consumed by electronic modules, and thus the amount of electrical power carried by the socket connectors, is increasing. Accordingly, more of the contacts of the socket connectors are being used to carry electrical power. Because of the limited space provided for the socket connectors, using more of the contacts to carry electrical power decreases the number of the contacts that carry electrical signals and/or grounds for a socket connector of a given size.

There is a need for a socket connector having an increased number of electrical signal and/or ground contacts for a given amount of electrical power carried by the socket connector. There is also a need for a socket connector having a decreased size for a given number of electrical signal and/or ground contacts.

BRIEF DESCRIPTION OF THE INVENTION

In one embodiment, a power blade is provided for a socket connector that connects a module card to a circuit board. The power blade includes a bus extending along a longitudinal axis, and a plurality of individual electrical contacts extending from the bus such that the electrical contacts are each electrically connected to the bus. The electrical contacts are located adjacent one another along the longitudinal axis. Each of the electrical contacts includes a side mating portion configured to electrically connect to the module card. The side mating portions of the electrical contacts lie in approximately a common plane.

In another embodiment, a socket connector is provided for connecting a module card to a circuit board. The socket connector includes a housing extending along a longitudinal axis between opposite end portions. The housing has a mounting face configured for mounting on the circuit board and a slot configured to receive a mating edge of the module card. A power blade is held by the housing and configured to carry electrical power. The power blade includes a bus extending a length along the longitudinal axis and a plurality of electrical contacts that extend from the bus such that the electrical contacts are electrically connected together. The electrical contacts are located adjacent one another along the longitudinal axis.

In another embodiment, a socket connector is provided for connecting a module card to a circuit board. The socket connector includes a housing extending along a longitudinal axis between opposite end portions. The housing has a mounting face configured for mounting on the circuit board and a slot configured to receive a mating edge of the module card. A power blade is held by the housing and includes a bus extending a length along the longitudinal axis and a plurality of first electrical contacts that extend from the bus such that the electrical contacts are electrically connected together. A plurality of second electrical contacts is held by the housing. Each of the second electrical contacts is configured to carry at least one of an electrical signal and an electrical ground. The first electrical contacts of the power blade are located along the longitudinal axis such that there are no intervening second electrical contacts between two adjacent first electrical contacts of the power blade.

DETAILED DESCRIPTION OF THE INVENTION

Figure 1:
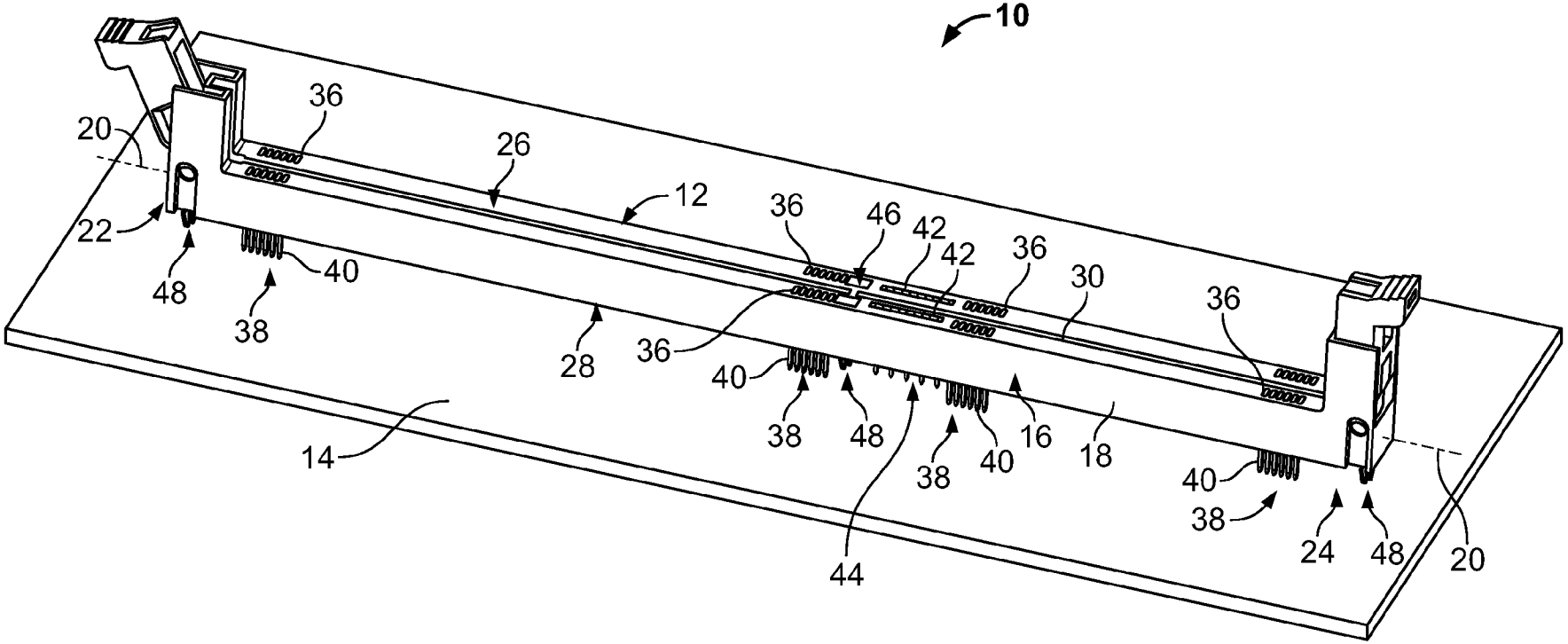
FIG. 1 is a partially exploded perspective view of an exemplary embodiment of a socket connector assembly.
Figure 2:
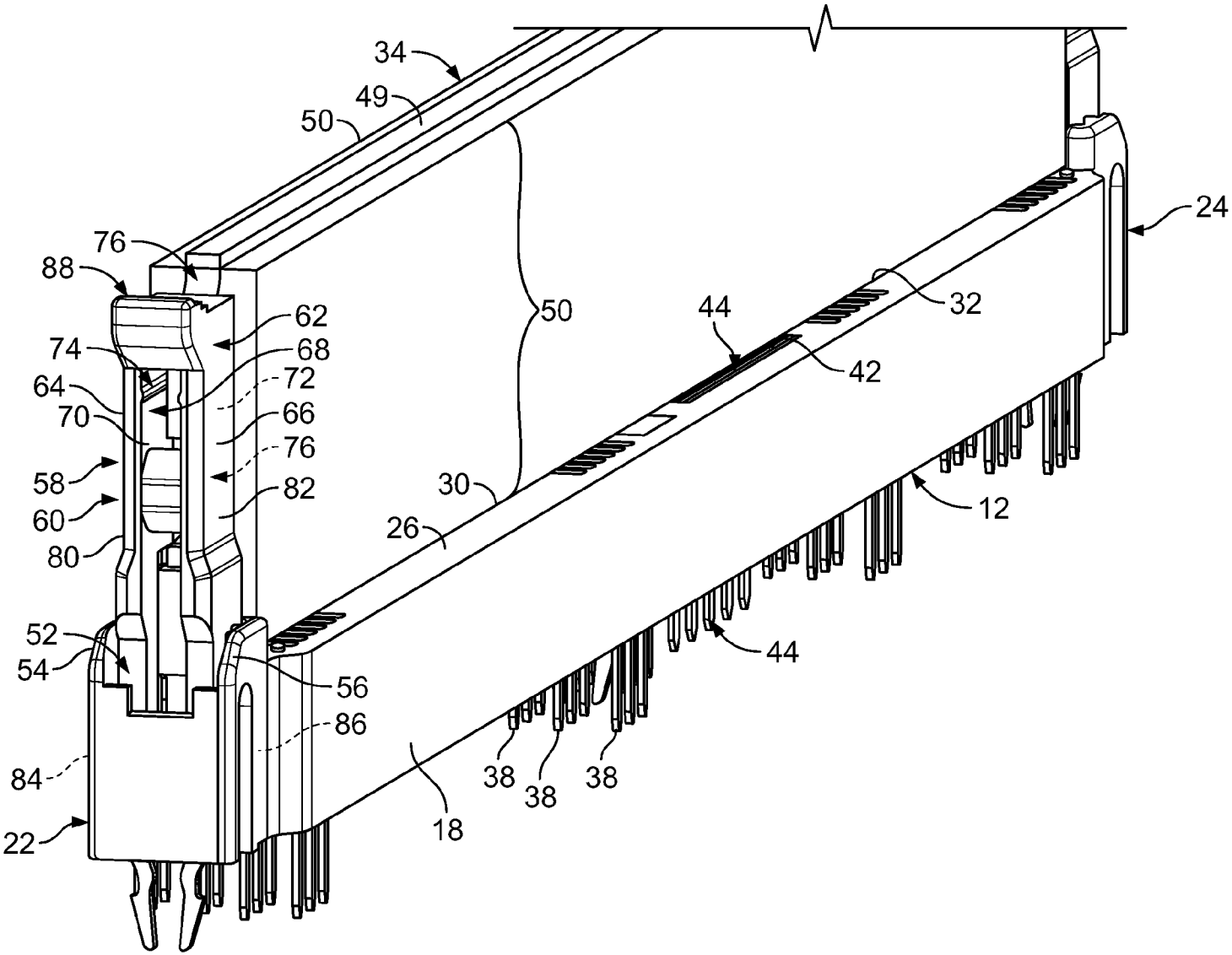
FIG. 2 is a partial perspective view of the socket connector shown in FIG. 1 with an exemplary electronic module installed thereon.

FIG. 1 is a partially exploded perspective view of an exemplary embodiment of a socket connector assembly 10. The socket connector assembly 10 includes a socket connector 12 and a circuit board 14. The socket connector 12 includes a housing 16 having a dielectric body 18 that extends along a central longitudinal axis 20 between opposite end portions 22 and 24. The body 18 has a mating face 26 and a mounting face 28. The body 18 includes a slot 30 that is configured to receive a mating edge portion 32 (FIG. 2) of an electronic module card 34 (FIG. 2). The housing body 18 includes a plurality of openings 36 that each communicate with the slot 30 and extend through the housing body 18 from the mating face 26 to the mounting face 28. Each opening 36 holds a portion of a corresponding electrical contact 38 therein. Each electrical contact includes a side mating portion (not shown) and a mounting contact area 40. The side mating portions extend into the slot 30 to electrically connect to contact pads (not shown) on the electronic module card 34 when the electronic module card 34 is installed in the socket connector 12. The mounting contact areas 40 extend from the mounting face 28 of the housing body 18 and are configured to electrically connect the socket connector 12 to the circuit board 14 to enable the connection of the electronic module card 34 to the circuit board 14. The electrical contacts 38 are each configured to carry electrical signals and/or electrical grounds and may each be referred to herein as a "second electrical contact".

The housing body 18 also includes a plurality of openings 42 that each communicate with the slot 30 and extend through the housing body 18 from the mating face 26 to the mounting face 28. As will be described below, each opening 42 holds a portion of a corresponding power blade 44 therein. Although two openings 42 are shown, the housing body 18 may include any number of openings 42 for holding any number of power blades 44. Moreover, the openings 42 may each be positioned anywhere along the length of the housing body 18, despite the specific locations shown in the illustrated embodiment of FIG. 1.

Optionally, a key 46 may be provided at an off-center position in the slot 30 for reception within a notch (not shown) in the electronic module card 34 to assure that the electronic module card 34 is properly aligned with respect to the socket connector 12. One or more board locks 48 are optionally provided to mechanically attach the socket connector 12 to the circuit board 14. In addition or alternative to the board locks 48, one or more alignment posts (not shown) are optionally provided to align the socket connector 12 with the circuit board 14.

FIG. 2 is a perspective view of the socket connector 12 with an exemplary electronic module card 34 installed thereon. The electronic module card 34 includes a planar substrate 49 that has the mating edge portion 32 and a plurality of electrical traces (not shown), each of which terminates at a corresponding contact pad (not shown) on the mating edge portion 32. When the electronic module card 34 is installed on the housing body 18 as shown in FIG. 2, some of the contact pads on the mating edge portion 32 of the electronic module card 34 electrically connect to the side mating portion (not shown) of a corresponding one of the electrical contacts 38. As will be described below, some of the contact pads on the mating edge portion 32 of the electronic module card 34 electrically connect to a corresponding one of the power blades 44 when the electronic module card 34 is installed on the housing body 18 as shown in FIG. 2. The substrate 49 includes exemplary surface mounted components generally represented at 50.

The housing end portions 22 and 24 are substantially identical and therefore only the housing end portion 22 is described in detail. The housing end portion 22 includes a cavity 52 between opposed towers 54 and 56 that extend outwardly at the mating face 26 of the housing body 18. An extractor 58 is received in the cavity 52. The extractor 58 is pivotably connected to the housing end portion 22 for retaining the electronic module card 34 on the housing body 18 and for extracting the electronic module card 34 from the housing body 18. Specifically, the extractor 58 extends outwardly between the towers 54 and 56 and is pivotable between an open position (FIG. 1) for receiving the electronic module card 34 within the slot 30 and a closed position (FIG. 2) for retaining the electronic module card 34.

The extractor 58 includes a pair of opposite side portions 60 and 62 that each engages the electronic module card 34. Specifically, each of the side portions 60 and 62 includes a side wall 64 and 66, respectively. The side walls 64 and 66 are spaced apart from one another such that an extractor slot 68 is defined therebetween. The extractor slot 68 is aligned with the slot 30 in the housing body 18. The extractor slot 68 receives an edge portion 76 of the substrate 49 of the electronic module card 34. Opposite interior surfaces 70 and 72 of the side walls 64 and 66, respectively, include ribs 74 that engage the side edge portion 76 of the substrate 49 of the electronic module card 34 to stabilize the electronic module card 34. Optionally, a beveled forward edge (not shown) on the ribs 74 provides guidance for facilitating entry of the edge portion 76 of the electronic module card 34 into the extractor slot 68. The extractor 58 may include a latch element (not shown) that engages a notch (not shown) in the edge portion 76 of the substrate 49 of the electronic module card 34 to facilitate retaining the electronic module card 34 on the housing body 18. Opposite outer surfaces 80 and 82 of the side walls 64 and 66, respectively, may include a projection (not shown) that communicates with a retention receptacle (not shown) on inner surfaces 84 and 86 of the towers 54 and 56, respectively, to facilitate holding the extractor 58 in the closed position. A foot (not shown) of the extractor 58 engages a lower edge (not shown) of the mating edge portion 32 of the electronic module card 34 to lift the electronic module card 34 upward when the extractor 58 is moved from the closed to the open position to assist in the extraction of the electronic module card 34 from the housing body 18. The extractor 58 optionally includes a thumb pad 88 for moving the extractor 58 between the open and closed positions.

Figure 3:
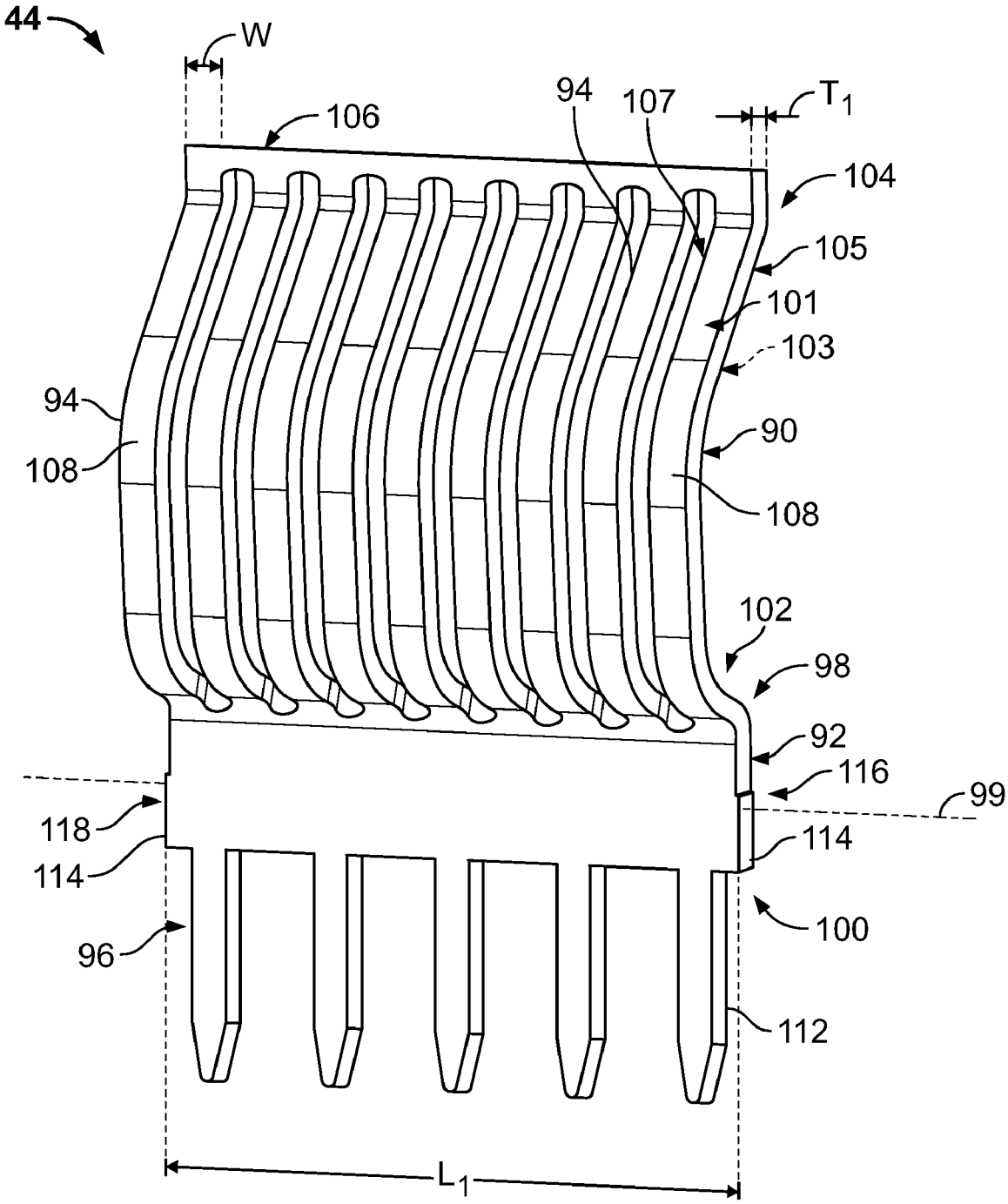
FIG. 3 is a perspective view of an exemplary embodiment of a power blade for use with the socket connector shown in FIGS. 1 and 2.
Figure 4:
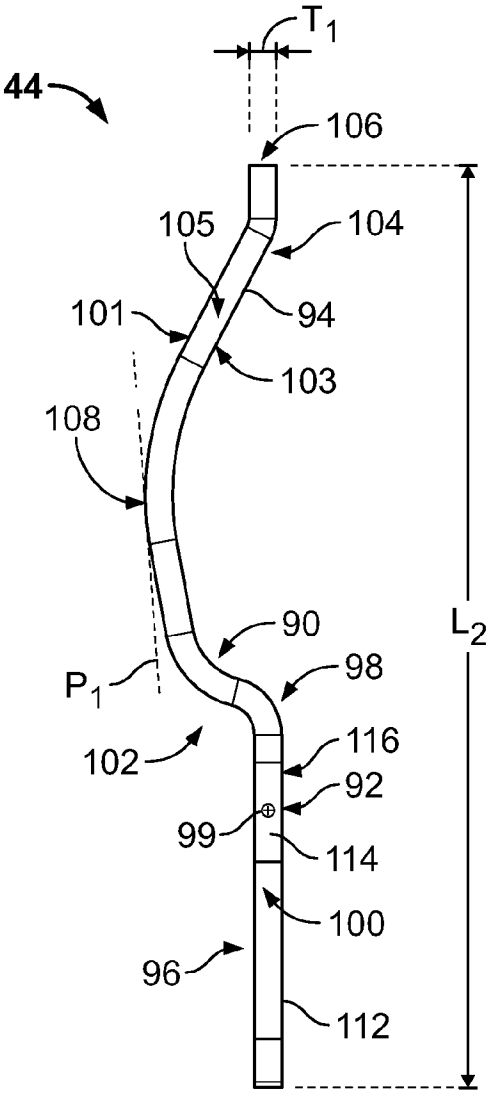
FIG. 4 is a side view of the power blade shown in FIG. 3.

FIG. 3 is a perspective view of an exemplary embodiment of the power blade 44. FIG. 4 is a side view of the power blade 44. The power blade 44 includes a body 90 that includes a bus 92, a plurality of electrical contacts 94, and a mounting contact area 96. The bus 92 may be referred to herein as a "first bus", while the electrical contacts 94 may each be referred to herein as a "first electrical contact". The bus 92 includes a pair of opposite side portions 98 and 100, which may be referred to herein as a "first side portion" and a "second side portion", respectively. The bus 92 extends a length $L_1$ along a longitudinal axis 99. In the illustrated embodiment of FIGS. 3 and 4, the electrical contacts 94 are mechanically and electrically connected to the side portion 98 of the bus 92. Specifically, each electrical contact 94 extends between an end portion 102 that extends from the side portion 98 of the bus 92 and an opposite end portion 104. The end portion 102 may be referred to herein as a "first end portion", while the end portion 104 may be referred to herein as a "second end portion". In the illustrated embodiment of FIGS. 3 and 4, the mounting contact area 96 extends along the side portion 100 of the bus 92.

Figure 5:
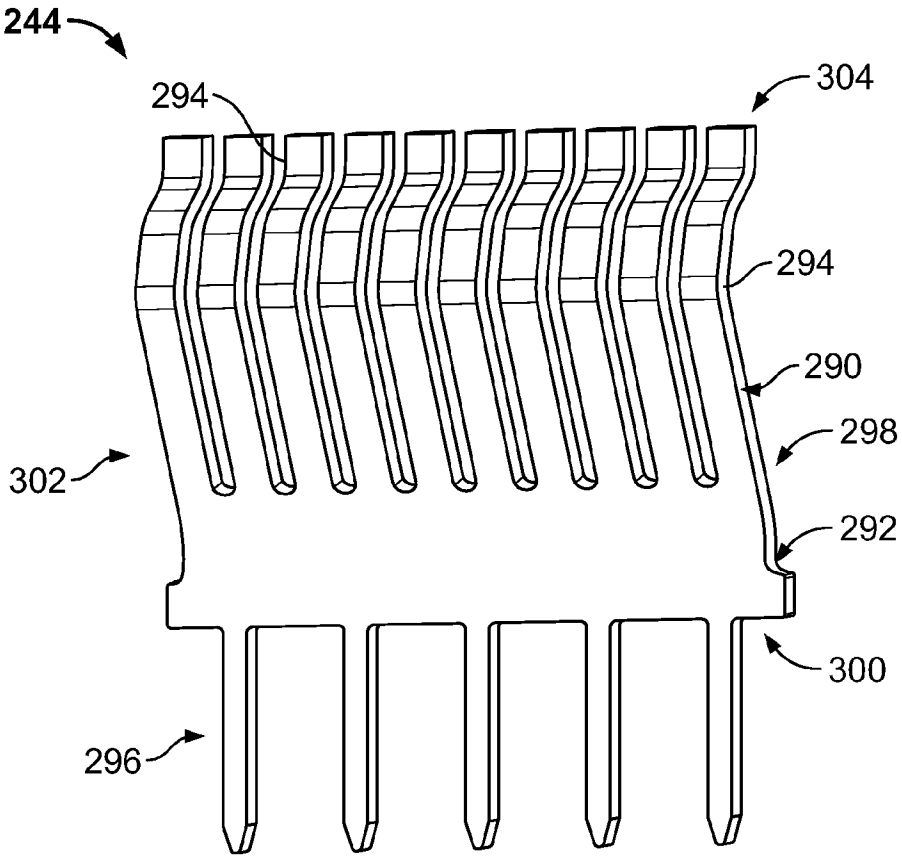
FIG. 5 is a perspective view of an exemplary alternative embodiment of a power blade for use with the socket connector shown in FIGS. 1 and 2.

In the illustrated embodiment of FIGS. 3 and 4, the power blade 44 includes another bus 106 that is mechanically and electrically connected to each of the electrical contacts 94. Specifically, the end portions 104 of each of the electrical contacts 94 extend from the bus 106 such that the electrical contacts 94 extend between the bus 92 and the bus 106. In some alternative embodiments, the power blade 44 does not include the bus 106. For example, FIG. 5 is a perspective view of an exemplary alternative embodiment of a power blade 244 for use with the socket connector 12 (FIGS. 1 and 2). The power blade 244 includes a body 290 that includes a bus 292, a plurality of electrical contacts 294, and a mounting contact area 296. The bus 292 may be referred to herein as a "first bus", while the electrical contacts 294 may each be referred to herein as a "first electrical contact". The bus 292 includes a pair of opposite side portions 298 and 300, which may be referred to herein as a "first side portion" and a "second side portion", respectively. In the illustrated embodiment of FIG. 5, the electrical contacts 294 are mechanically and electrically connected to the side portion 298 of the bus 292. Specifically, each electrical contact 294 extends between an end portion 302 that extends from the side portion 298 of the bus 292 and an opposite free end portion 304. The end portion 302 may be referred to herein as a "first end portion", while the end portion 304 may be referred to herein as a "second end portion".

Referring again to the FIGS. 3 and 4, the electrical contacts 94 may be formed integrally with the bus 92 and/or with the bus 106. Alternatively, one or more of the electrical contacts 94 may be formed separated from the bus 92 and/or the bus 106 and thereafter mechanically and electrically connected thereto. Each of the electrical contacts 94 extends a length $L_2$ along a direction transverse to the longitudinal axis 99 of the bus 92. Each electrical contact 94 extends a cross-sectional thickness $T_1$ between a pair of opposite side portions 101 and 103, and extends a width W between a pair of opposite edge portions 105 and 107. The electrical contacts 94 are located adjacent one another along the longitudinal axis 99 of the bus 92 such that the edge portions 105 of the electrical contacts 94 face the edge portion 107 of any adjacent electrical contacts 94, and vice versa. The side portions 101 of the electrical contacts 94 each include a side mating portion 108. When the power blade 44 is held within the corresponding opening 42 (FIGS. 1, 2, and 6) of the housing body 18 (FIGS. 1, 2, and 6), the side mating portions 108 each extend into the slot 30 (FIGS. 1, 2, and 6) for electrical connection to contact pads (not shown) on the electronic module card 34 (FIG. 2). Specifically, each side mating portion 108 engages the corresponding contact pad of the electronic module card 34. In the illustrated embodiments of FIGS. 3 and 4, and as can be seen best in FIG. 4, the side mating portions 108 of each of the electrical contacts 94 of the power blade 44 lie in approximately a common plane $P_1$ (FIG. 4). The side mating portions 108 are optionally be springs that deflect when engaged with the corresponding contact pad of the electronic module card 34.

The mounting contact area 96 of the power blade 44 is configured to electrically connect to the circuit board 14 (FIG. 1). In the illustrated embodiment of FIGS. 3 and 4, the mounting contact area 96 includes a plurality of solder tails 112 that electrically connect to the circuit board 14 using solder. However, the mounting contact area 96 is not limited to using solder tails, but rather may have any suitable arrangement, configuration, structure, means, geometry, and/or the like that enables the mounting contact area 96 to electrically connected to the circuit board 14 and/or another electrical component, such as, but not limited to, using a press-fit arrangement, a surface mount arrangement, and/or the solder tail arrangement. Although five solder tails 112 are shown, the mounting contact area 96 may include any number of solder tails 112 and/or any number of other mounting components.

The components of mounting contact area 96, for example the solder tails 112 in the illustrated embodiment of FIGS. 3 and 4, may be formed integrally with the bus 92. Alternatively, one or more of the components of mounting contact area 96, for example the solder tails 112 in the illustrated embodiment of FIGS. 3 and 4, may be formed separated from the bus 92 and thereafter mechanically and electrically connected thereto.

The power blade 44 optionally includes a pair of extensions 114 that extend outwardly from opposite end portions 116 and 118 of the bus 92. The extensions 114 are configured to engage the housing body 18 to facilitate retaining the power blade 44 in position within the corresponding opening 42 of the housing body 18 using an interference-fit arrangement. Although two extensions 114 are shown, the power blade 44 may include any number of extensions 114. Moreover, although shown as extending from the bus 92, each extension 114 may extend from any location on the body 90 of the power blade 44. In addition or alternative to the extensions 114, the power blade 44 may be held within the corresponding opening 42 of the housing body 18 using any other suitable arrangement, configuration, structure, means, geometry, and/or the like.

The size, shape, and location on the power blade body 90 of the bus 92, the bus 106, the mounting contact area 96, and the electrical contacts 94 (including the side portions 101 and 103, the side mating portions 108, and the edge portions 105 and 107), as well as the overall size and geometry of the power blade body 90, is not limited to the embodiments described and illustrated herein, but rather may be any suitable size, shape, location, and/or geometry that enables the power blade 44 to function as described and/or illustrated herein.

The power blade 44 and its various components (e.g., the electrical contacts 94, the buses 92 and 106, and the mounting contact area 96) are configured to carry electrical power to the circuit board 14 and the electronic module card 34. Because the electrical contacts are electrically connected together by the bus 92 and/or the bus 106, the power blade body 90 can carry a greater amount of electrical power (such as, but not limited to, amperage and/or voltage) than the electrical contacts 94 would be able to carry if they were not electrically connected together. A size, shape, and/or cross sectional thickness $T_1$ of the power blade body 90 overall and/or of each of the electrical contacts 94, the buses 92 and/or 106, the mounting contact area 96, and/or the like may be selected to enable the power blade body 90 to carry a predetermined amount of electrical power. In addition or alternative, the number of the electrical contacts 94, whether the bus 106 is included, and/or a pitch that separates each of the electrical contacts 94 from the adjacent electrical contacts 94 within the power blade 44 may be selected to enable the power blade body 90 to carry a predetermined amount of electrical power. Although nine electrical contacts 94 are shown in FIGS. 3 and 4, the power blade 44 may include any number of electrical contacts 94 to facilitate providing a predetermined amount of electrical power. In some embodiments, the electrical contacts 94 are separated from adjacent electrical contacts 94 within the power blade 44 by a pitch of less than approximately 0.020 inches (approximately 0.508 mm). In some embodiments, one or more of the electrical contacts has a cross-sectional thickness $T_1$ that is greater than a cross sectional thickness of the electrical contacts 38.

Figure 6:
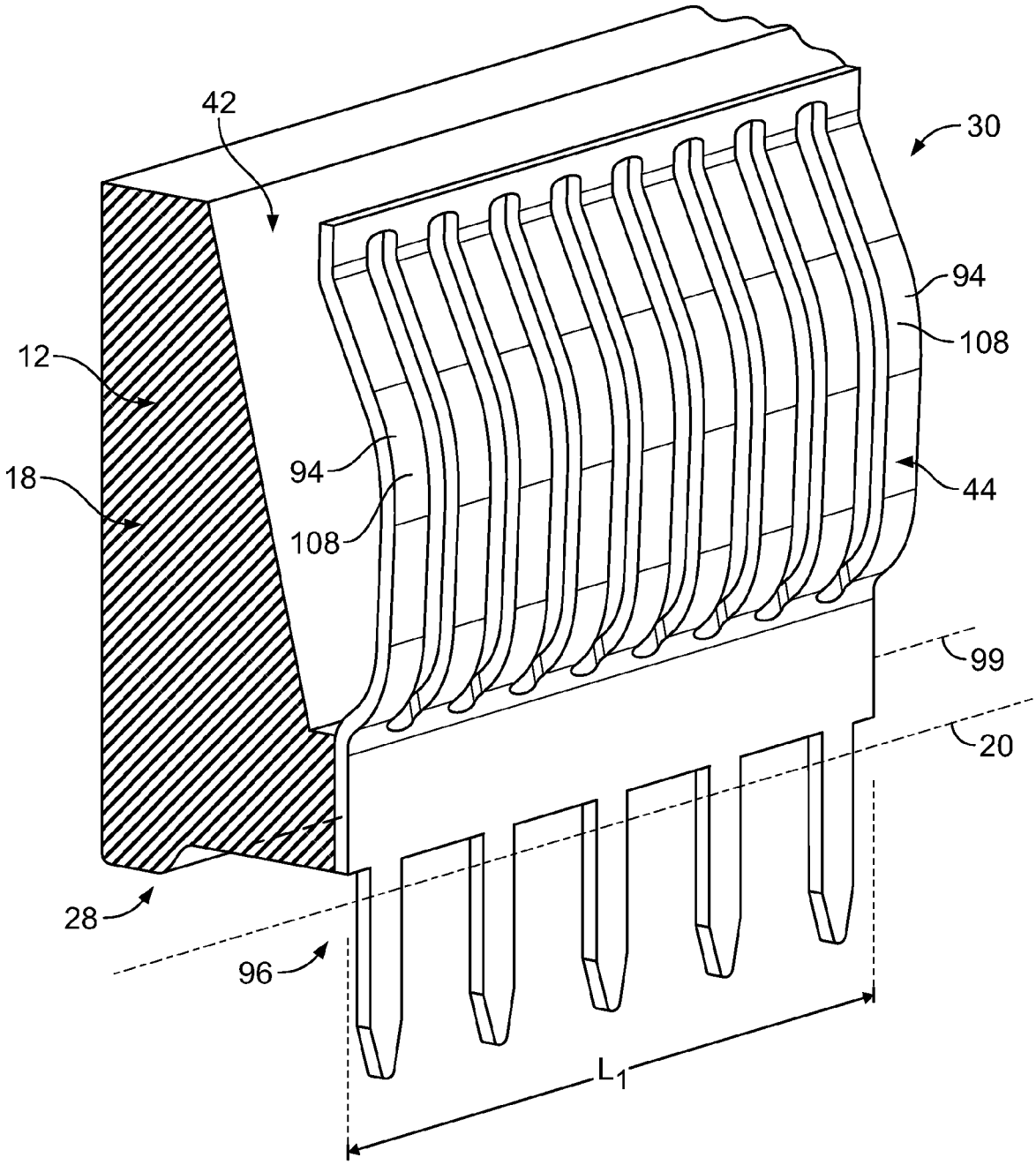
FIG. 6 is a perspective view illustrating a cross-section of a portion of the socket connector shown in FIGS. 1 and 2.

Referring now to FIGS. 1 and 6, when the power blade 44 is received within the corresponding opening 42 of the housing body 18, the length $L_1$ of the bus 92 of the power blade 44 extends along the longitudinal axis 20 of the housing body 18 such that the longitudinal axis 99 of the bus 92 is approximately parallel with the longitudinal axis 20 of the housing body 18. The electrical contacts 94 are located immediately adjacent one another along the longitudinal axes 99 and 20 such that there are no intervening electrical contacts 38 between the electrical contacts 94 of a single power blade 44. As should be evident from the Figures, none of the electrical contacts 38 (FIGS. 1 and 2) extend between adjacent ones of the electrical contacts 94 of the power blade 44. When the power blade 44 is received within the corresponding opening 42 of the housing body 18, the side mating portions 108 of the electrical contacts 94 extend into the slot 30 to electrically connect to the corresponding contact pads (not shown) of the electronic module card 34 (FIG. 2). The mounting contact area 96 extends along the mounting face 28 of the housing body 18 and is configured to electrically connect the socket connector 12 to the circuit board 14 (FIG. 1). Although the socket connector 12 is shown as including two power blades 44, the socket connector 12 may hold any number of power blades 44 for carrying any amount of electrical power between the circuit board 14 and the electronic module card 34.

Figure 8:
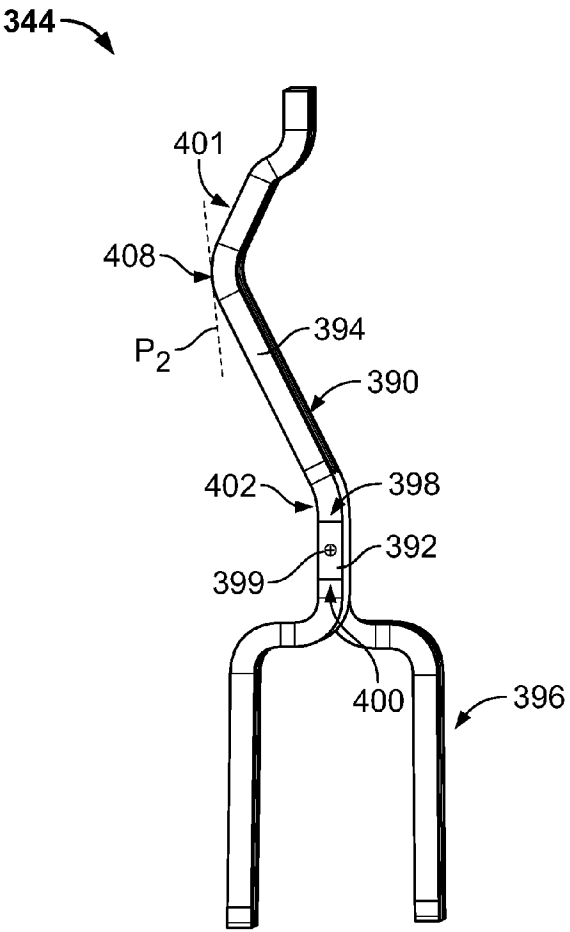
FIG. 8 is a side view of the power blade shown in FIG. 7.
Figure 7:
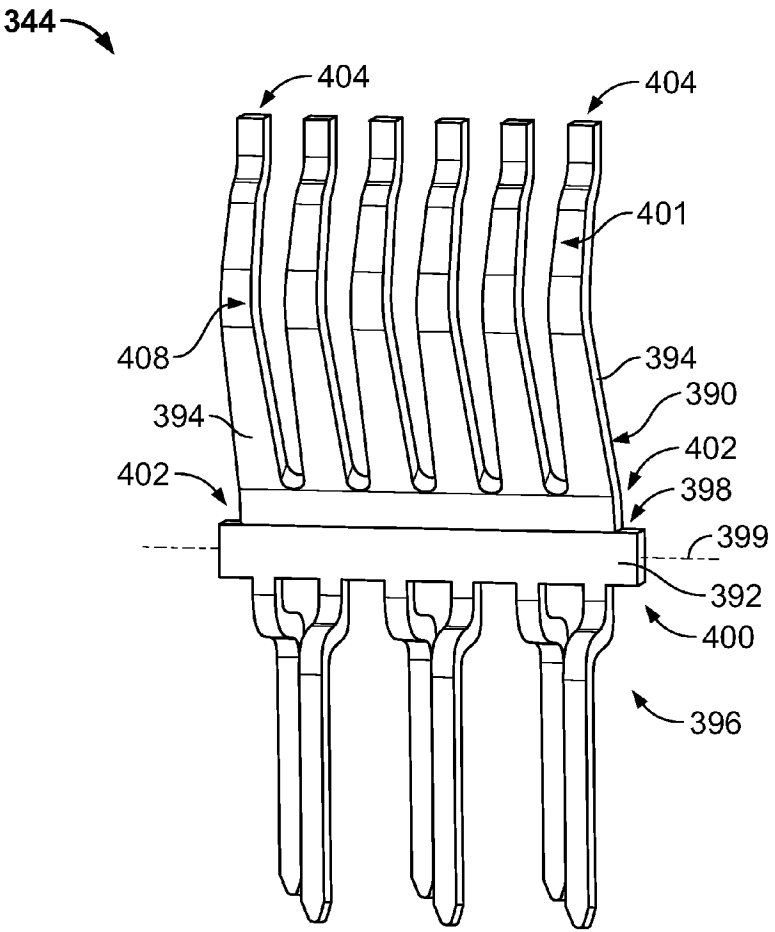
FIG. 7 is a perspective view of an exemplary alternative embodiment of a power blade for use with the socket connector shown in FIGS. 1 and 2.

FIG. 7 is a perspective view of an exemplary alternative embodiment of a power blade 344 for use with the socket connector 12 (FIGS. 1 and 2). FIG. 8 is a side view of the power blade 344. The power blade 344 includes a body 390 that includes a bus 392, a plurality of electrical contacts 394, and a mounting contact area 396. The bus 392 may be referred to herein as a "first bus", while the electrical contacts 394 may each be referred to herein as a "first electrical contact". The bus 392 extends a length $L_3$ along a longitudinal axis 399. The bus 392 includes a pair of opposite side portions 398 and 400, which may be referred to herein as a "first side portion" and a "second side portion", respectively. In the illustrated embodiment of FIGS. 7 and 8, the electrical contacts 394 are mechanically and electrically connected to the side portion 398 of the bus 392. Specifically, each electrical contact 394 extends between an end portion 402 that extends from the side portion 398 of the bus 392 and an opposite free end portion 404. The power blade 344 optionally includes another bus (not shown) that is mechanically and electrically connected to the end portions 404 of each of the electrical contacts 394. The end portion 402 may be referred to herein as a "first end portion", while the end portion 404 may be referred to herein as a "second end portion".

In the illustrated embodiment of FIGS. 7 and 8, the mounting contact area 396 includes a plurality of solder tails 412 that electrically connect to the circuit board 14 (FIG. 1) using solder. However, the mounting contact area 96 is not limited to using solder tails, but rather may have any suitable arrangement, configuration, structure, means, geometry, and/or the like that enables the mounting contact area 396 to electrically connected to the circuit board 14 and/or another electrical component, such as, but not limited to, using a press-fit arrangement, a surface mount arrangement, and/or the solder tail arrangement. Although six solder tails 412 are shown, the mounting contact area 496 may include any number of solder tails 412 and/or any number of other mounting components. As can be seen in FIGS. 7 and 8, adjacent solder tails 412 are staggered on opposite sides of the longitudinal axis 399.

Each of the electrical contacts 394 includes a side portion 401 that includes a side mating portion 408. Each side mating portion 108 engages the corresponding contact pad of the electronic module card 34 (FIG. 2). In the illustrated embodiments of FIGS. 7 and 8, and as can be seen best in FIG. 8, the side mating portions 408 of each of the electrical contacts 394 of the power blade 344 lie in approximately a common plane $P_2$ (FIG. 8).

The embodiments described and illustrated herein provide a socket connector that may have an increased number of electrical signal and/or ground contacts for a given amount of electrical power carried by the socket connector. The embodiments described and illustrated herein provide a socket connector that may have a decreased size for a given number of electrical signal and/or ground contacts.

The socket connector embodiments described and/or illustrated herein are not limited to use with any exemplary type of electronic module card described and/or illustrated herein, but rather may be used with any suitable type of electronic module card, such as, but not limited to, processor modules and/or memory modules, such as, but not limited to, Dynamic Random Access Memory (DRAM), Synchronous Dynamic Random Access Memory (SDRAM), Extended Data Out Random Access Memory (EDO RAM), Single In-line Memory Modules (SIMM's), Dual In-line Memory Modules (DIMM's), Small Outline DIMM's (SODIMM's), Fully Buffered DIMM's, and/or the like.

It is to be understood that the above description is intended to be illustrative, and not restrictive. For example, the above-described embodiments (and/or components, steps, and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." When introducing elements/components/etc. described and/or illustrated herein, the articles "a", "an", "the", "said", and "at least one" are intended to mean that there are one or more of the element(s)/component(s)/etc. Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

While the subject matter described and illustrated herein has been described in terms of various specific embodiments, those skilled in the art will recognize that the subject matter described and illustrated herein can be practiced with modification within the spirit and scope of the claims.

What is claimed is:

1. A power blade for a socket connector that connects a module card to a circuit board, said power blade comprising:

a bus extending along a longitudinal axis;

a plurality of individual electrical contacts extending from the bus such that the electrical contacts are each electrically connected to the bus, the electrical contacts being located adjacent one another along the longitudinal axis, each of the electrical contacts comprising a side mating portion configured to electrically connect to the module card, wherein the side mating portions of the electrical contacts lie in approximately a common plane; and mounting components extending from the bus for electrically connecting the power blade to the circuit board, wherein adjacent mounting components are staggered on opposite sides of the longitudinal axis of the bus.

2. The power blade according to claim 1, wherein the electrical contacts are formed integrally with the bus.

3. The power blade according to claim 1, wherein each of the electrical contacts extends a length along a transverse direction relative to the longitudinal axis.

4. The power blade according to claim 1, wherein the bus is a first bus and the electrical contacts each extend between a first end portion that extends from the first bus and an opposite second end portion that extends from a second bus.

5. The power blade according to claim 1, wherein the bus is a first bus and the electrical contacts are each integrally formed with a second bus.

6. The power blade according to claim 1, further comprising a mounting contact area formed integrally with the bus, the mounting contact area being configured to electrically connect to the circuit board.

7. The power blade according to claim 1, further comprising a mounting contact area configured to electrically connect to the circuit board, wherein the electrical contacts extend from a first side portion of the bus and the mounting contact area extends along a second side portion of the bus that is opposite the first side portion.

8. The power blade according to claim 1, further comprising a mounting contact area configured to electrically connect to the circuit board using at least one of a press-fit arrangement, a surface mount arrangement, and a solder tail arrangement.

9. The power blade according to claim 1, wherein an electrical contact of the plurality of electrical contacts is spaced apart from another of the electrical contacts along the longitudinal axis by a pitch of less than approximately 0.020 inches.

10. A socket connector for mounting on a circuit board, said socket connector comprising:

a housing extending along a longitudinal axis between opposite end portions, the housing having a mounting face configured for mounting on the circuit board and a slot;

a module card having a mating edge received within the slot of the housing; and a power blade held by the housing and configured to carry electrical power, the power blade comprising a bus extending a length along the longitudinal axis and a plurality of electrical contacts that extend from the bus such that the electrical contacts are electrically connected together, wherein the electrical contacts are located adjacent one another along the longitudinal axis, each of the electrical contacts comprising a side mating portion electrically connected to the module card, wherein the side mating portions of the electrical contacts lie in approximately a common plane, the power blade further comprising mounting components extending from the bus for electrically connecting the power blade to the circuit board, wherein adjacent mounting components are staggered on opposite sides of the longitudinal axis of the bus.

11. The socket connector according to claim 10, wherein the electrical contacts are formed integrally with the bus.

12. The socket connector according to claim 10, wherein the bus is a first bus and each of the electrical contacts of the power blade each extend between a first end portion that extends from the first bus and an opposite second end portion that extends from a second bus.

13. The socket connector according to claim 10, wherein the bus is a first bus and the electrical contacts are each integrally formed with a second bus.

14. The socket connector according to claim 10, wherein the electrical contacts extend from a first side portion of the bus and the mounting components extend from a second side portion of the bus that is opposite the first side portion.

15. The socket connector according to claim 10, wherein the mounting components are configured to electrically connect to the circuit board using at least one of a press-fit arrangement, a surface mount arrangement, and a solder tail arrangement.

16. The socket connector according to claim 10, wherein an electrical contact of the plurality of electrical contacts is spaced apart from another of the electrical contacts by a pitch of less than approximately 0.020 inches.

17. The socket connector according to claim 10, wherein the electrical contacts of the power blade are each first electrical contacts, the socket connector further comprising a plurality of second electrical contacts held by the housing, each of the second electrical contacts being configured to carry at least one of an electrical signal and an electrical ground, wherein each of the second electrical contacts extends into the slot of the housing.

* * * * *